United States Patent [19]

Towery

[11] 4,204,519

[45] May 27, 1980

[54] FORCED HOT AIR FIREPLACE ATTACHMENT

[76] Inventor: Mark W. Towery, 5750 Sheridan Dr., Williamsville, N.Y. 14221

[21] Appl. No.: 905,479

[22] Filed: Jul. 24, 1978

[51] Int. Cl.[2] ..... F23H 13/00

[52] U.S. Cl. ..... 126/164; 126/121; 237/51

[58] Field of Search ..... 126/121, 131, 164, 165, 126/132, 143; 237/51

[56] References Cited

U.S. PATENT DOCUMENTS

| | | | |
|---|---|---|---|
| 3,901,212 | 8/1975 | Stites | 126/121 |
| 3,942,509 | 3/1976 | Sasser | 126/121 |
| 4,019,492 | 4/1977 | Rush | 126/121 |
| 4,020,824 | 5/1977 | Dodson | 126/164 |
| 4,060,196 | 11/1977 | Goldsby | 126/121 |
| 4,062,345 | 12/1977 | Whiteley | 126/121 |
| 4,077,388 | 3/1978 | Whiteley | 126/121 |

*Primary Examiner*—James C. Yeung
*Attorney, Agent, or Firm*—Allen J. Jaffe

[57] ABSTRACT

A forced hot air woodburning fireplace attachment including a blower, a header communicating with the blower and a plurality of generally C-shaped tubes each having one end connected to the header. The other end of the tubes facing away from the fireplace and towards a room to be heated and at least one of these ends having connected thereto a bypass conduit for delivering air directly to the fire.

1 Claim, 1 Drawing Figure

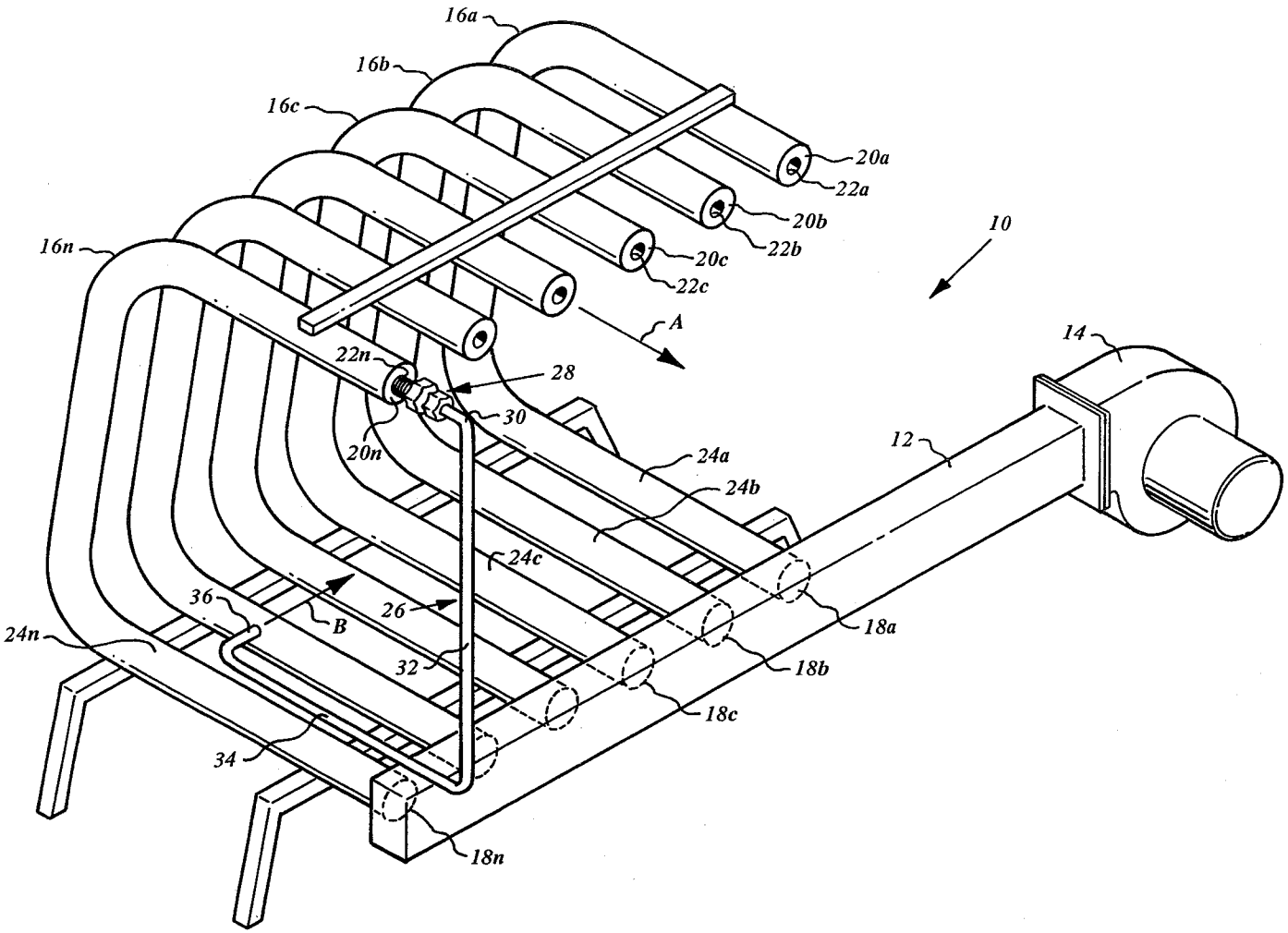
10
12
14
16a
16b
16c
16n
18a
18b
18c
18n
20a
20b
20c
20n
22a
22b
22c
22n
24a
24b
24c
24n
26
28
30
32
34
36
A
B

FORCED HOT AIR FIREPLACE ATTACHMENT

BACKGROUND OF THE INVENTION

The present invention relates to attachments for woodburning fireplaces and, more particularly, to an attachment of the type wherein forced hot air is blown into a room to transfer heat from the fire to the room.

Although, once the fire is fully started, attachments of this type provide more efficient heat transfer than that which would be radiated by the fire itself, they are subject to several drawbacks, among which are:

1. Requires just as much tending as normal radiant fire;
2. Starting is just as difficult; especially with "green" wood;
3. Build up of smoke is substantially the same as normal radiant fire; and
4. Ash build up is substantially the same as normal radiant fire.

SUMMARY OF THE INVENTION

The above disadvantages are overcome according to the teachings of the present invention which provides a simple, durable and inexpensive attachment to forced hot air fireplace heat exchangers which permits faster starting (even with "green" wood), less tending, less smoke, build-up of red coals for more heat and leaves less ashes.

Additionally, the attachment according to the present invention fits easily to conventional heat exchange units, is attractive and doesn't interfere with normal access to the wood.

Basically, then, the present invention provides in a forced hot air heat exchanger for woodburning fireplaces of the type having a blower connected to a header and a plurality of C-shaped tubes each having one end in communication with the header and the other end facing away from the fireplace and into a space to be heated, the improvement comprising conduit means attached to at least one of the other ends of the tubes for directing air therefrom into the fireplace in a direction that is substantially perpendicular to the normal outflow of air from the tubes.

BRIEF DESCRIPTION OF THE DRAWING

For a fuller understanding of the present invention, reference should now be had to the following detailed description thereof taken in conjunction with the accompanying drawing wherein;

The only FIGURE is a pictorial view of the forced hot air fireplace heat exchanger depicting the attachment thereto of the present invention.

DESCRIPTION OF THE PREFERRED EMBODIMENT

Referring to the drawing, a conventional forced hot air fireplace heat exchanger is generally depicted at 10 and comprises a substantially rectangular sectioned elongated hollow leader 12 for supplying air from a blower 14 to a plurality of parallel, generally, C-shaped heat exchange tubes 16*a*, 16*b*, 16*c* . . . 16*n*. Each tube has one end 18*a*, 18*b*, 18*c* . . . 18*n* connected to and in communication with the header 12, as is conventional. The other end of each tube, depicted at 20*a*, 20*b*, 20*c* . . . 20*n*, terminates in a discharge opening 22*a*, 22*b*, 22*c* . . . 22*n* that faces the direction of the room or space to be heated and which normally supplies air heated from the fire into said space under the force of blower 14 in the direction of arrow A. Wood (not shown) is adapted to be supported by the supply legs 24*a*, 24*b*, 24*c* . . . 24*n* of the tubes, as is conventional.

According to the present invention conduit means are provided for attachment to at least one of the discharge openings 22*a*, 22*b*, 22*c* . . . 22*n* for directing or deflecting the air flowing therefrom back into the woodburning fire. Such means may take the form of a specially shaped length of pipe, depicted generally at 26 connected at one end by any suitable, well known structure to a discharge opening 22*n*. Such structure is illustratively depicted as a male connector 28 removable fitted into opening 22*n* and attached to an upper horizontal section 30 of pipe 26 that is coaxial with opening 22*n*. Section 30 terminates in a substantially vertical section 32 that extends downwardly in the plane of tube 16 to a point just above header 12. At this point section 32 bends into a substantially lower horizontal section 34 which is parallel to and in the plane of section 30. Section 34 extends rearwardly towards the bright of tube 16*n* and terminates in an outlet horizontal section 36 in the plane thereof and facing perpendicular to the normal direction of openings 22*a*, 22*b*, 22*c* . . . 22*n* for delivering air in the direction of arrow B directly into the woodburning fire.

The operation of the present invention should be readily apparent from the foregoing description thereof. Thus, when a fire is started and the blower 14 is switched on, a portion of the air blown through heat exchange tubes is by-passed via attachment 26 back into the wood. It has been found that this bypass flow functions; to dry wet or "green" wood; to increase the heat of the fire; to cause less smoke to be generated; to leave less ashes; and to maintain an efficient and continuous fire which requires less tending.

Although a preferred embodiment of the present invention has been disclosed and described, changes will obviously occur to those skilled in the art. It is, therefore, intended that the present invention is to be only limited by the scope of the appended claims.

I claim:

1. In a forced hot air heat exchanger for woodburning fireplaces having a blower connected to a header and a plurality of heat exchange tubes each having one end in communication with the header and the other end of each having an opening facing away from the fireplace and toward a space to be heated for directing air thereto; the improvement, comprising;

conduit means in communication with at least one of the openings for directing air therefrom into the fireplace, said conduit means comprising;

an upper horizontal section having removable coupling means connecting to at least one of the openings, a vertical section connected to said upper horizontal section substantially in the plane thereof;

a lower horizontal section connected to said vertical section, and an outlet horizontal section connected to said lower horizontal section generally perpendicular thereto and substantially out of the plane thereof for discharging air into the fireplace in a direction that is generally perpendicular to the facing direction of the openings.

* * * * *